US008136589B2

(12) United States Patent
Holderman et al.

(10) Patent No.: US 8,136,589 B2
(45) Date of Patent: Mar. 20, 2012

(54) SAND CONTROL SCREEN ASSEMBLY HAVING CONTROL LINE CAPTURE CAPABILITY

(75) Inventors: Luke William Holderman, Plano, TX (US); Jean-Marc Lopez, Plano, TX (US); Nicholas Kuo, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/796,588

(22) Filed: Jun. 8, 2010

(65) Prior Publication Data

US 2011/0297376 A1 Dec. 8, 2011

(51) Int. Cl.
*E03B 3/18* (2006.01)

(52) U.S. Cl. ..... 166/227; 166/205; 166/144; 166/158

(58) Field of Classification Search ..... 166/227, 166/205, 158, 144, 74, 56, 129
See application file for complete search history.

(56) References Cited

U.S. PATENT DOCUMENTS

| | | | | |
|---|---|---|---|---|
| 6,516,882 | B2 | 2/2003 | McGregor et al. | |
| 6,681,854 | B2 | 1/2004 | Danos | |
| 6,789,624 | B2 | 9/2004 | McGregor et al. | |
| 6,983,796 | B2 | 1/2006 | Bayne et al. | |
| 7,100,690 | B2 | 9/2006 | Mullen et al. | |
| 7,802,622 | B2 * | 9/2010 | Roaldsnes | 166/241.1 |

* cited by examiner

*Primary Examiner* — Daniel P Stephenson
*Assistant Examiner* — Yong-Suk Ro
(74) *Attorney, Agent, or Firm* — Lawrence R. Youst

(57) ABSTRACT

A sand control screen assembly having control line capture capability is operable for use in a subterranean wellbore. The sand control screen assembly includes a base pipe having a screen jacket positioned therearound for preventing the flow of particulate material of a predetermined size therethrough and allowing the flow of production fluids therethrough. The sand control screen assembly also includes a control line capture assembly. The control line capture assembly includes an axially extending flange that couples to the screen jacket and is operable to protect the control line during installation and operation of the sand control screen in the wellbore. The control line capture assembly also includes an axially extending spring channel that couples to the flange. The channel is operable to receive and retain the control line during installation and operation of the sand control screen in the wellbore.

13 Claims, 5 Drawing Sheets

SAND CONTROL SCREEN ASSEMBLY HAVING CONTROL LINE CAPTURE CAPABILITY

TECHNICAL FIELD OF THE INVENTION

This invention relates, in general, to equipment utilized in conjunction with operations performed in subterranean wells and, in particular, to a sand control screen assembly that has a control line capture assembly operable to receive, retain and protect the control line during installation and operation of the sand control screen assembly.

BACKGROUND OF THE INVENTION

Without limiting the scope of the present invention, its background will be described with reference to producing fluid from a hydrocarbon bearing subterranean formation, as an example.

It is well known in the subterranean well drilling and completion art that relatively fine particulate materials may be produced during the production of hydrocarbons from a well that traverses an unconsolidated or loosely consolidated formation. Numerous problems may occur as a result of the production of such particulate. For example, the particulate causes abrasive wear to components within the well, such as flow control devices, safety equipment, tubing and the like. In addition, the particulate may partially or fully clog the well creating the need for an expensive workover. Also, if the particulate matter is produced to the surface, it must be removed from the hydrocarbon fluids using surface processing equipment.

One method for preventing the production of such particulate material is to gravel pack the well adjacent to the unconsolidated or loosely consolidated production interval. In a typical gravel pack completion, sand control screen assemblies are lowered into the wellbore as part of a completion string to a position proximate the desired production interval. A fluid slurry including a liquid carrier and a relatively coarse particulate material, such as sand, gravel or proppants which are typically sized and graded and which are typically referred to herein as gravel, is then pumped down the work string and into the well annulus formed between the sand control screen assemblies and the perforated well casing or open hole production zone. The liquid carrier either flows into the formation or returns to the surface by flowing through a wash pipe or both. In either case, the gravel is deposited around the sand control screen assemblies to form the gravel pack, which is highly permeable to the flow of hydrocarbon fluids but blocks the flow of the fine particulate materials carried in the hydrocarbon fluids. As such, gravel packs can successfully prevent the problems associated with the production of these particulate materials from the formation.

It is also well known in the subterranean well drilling and completion art that it is desirable to install smart well components that enable the management of downhole equipment and production fluids. For example, these smart well components may include one or more sensing devices such as temperature sensors, pressure sensors, flow rate sensors, fluid composition measurement devices or the like as well as control mechanisms such as flow control devices, safety devices and the like. These smart well systems are typically controlled or communicated with using one or more control lines that may include hydraulic lines, electrical lines, fiber optic bundles or the like and combination thereof.

It has been found, however, that control lines installed over sand control screen assemblies are susceptible to damage during installation and operation of the sand control screen assemblies in the wellbore. Accordingly, a need has arisen for a sand control screen assembly operable to receive, retain and protect the control lines during installation and operation of the sand control screen assembly.

SUMMARY OF THE INVENTION

The present invention disclosed herein comprises a sand control screen assembly that has a control line capture assembly operable to receive, retain and protect the control line during installation and operation of the sand control screen assembly. In one implementation, the control line capture assembly utilizes a spring channel that is operable to receive and retain the control line and a flange assembly that is operable to protect the control line during installation and operation of the sand control screen assembly.

In one aspect, the present invention is directed to a sand control screen assembly having control line capture capability for use in a subterranean wellbore. The sand control screen assembly includes a base pipe and a screen jacket positioned around the base pipe that is operable to prevent the flow of particulate material of a predetermined size therethrough and to allow the flow of production fluids therethrough. The sand control screen assembly also includes a control line capture assembly coupled to the screen jacket. The control line capture assembly is operable to receive, retain and protect the control line during installation and operation of the sand control screen in the wellbore.

In one embodiment of the sand control screen assembly, the screen jacket includes an outer shroud. In another embodiment of the sand control screen assembly, the control line capture assembly may include an axially extending flange that is coupled to the screen jacket by welding, bonding or other suitable technique, wherein the flange is operable to receive and retain the control line. In this embodiment, the flange may be mechanically formable to retain the control line. In this embodiment, the forming process may preferably take place on the rig floor and may be a manual process or an automated process.

In another embodiment of the sand control screen assembly, the control line capture assembly may include an axially extending flange coupled to the screen jacket, wherein the flange is operable to protect the control line during installation and operation of the sand control screen in the wellbore. In this embodiment, an axially extending channel, such as a spring channel, may be coupled to the flange, wherein the channel is operable to receive and retain the control line. Also in this embodiment, the flange may have a channel receptacle and a pair of oppositely disposed legs having a plurality axially distributed openings such that the flange forms a pair of axially extending fluid passageways with the screen jacket.

In another aspect, the present invention is directed to a sand control screen assembly having control line capture capability for use in a subterranean wellbore. The sand control screen assembly includes a base pipe and a screen jacket positioned around the base pipe that is operable to prevent the flow of particulate material of a predetermined size therethrough and to allow the flow of production fluids therethrough. The sand control screen assembly also includes a control line capture assembly operably associated with the screen jacket. The control line capture assembly includes an axially extending flange coupled to the screen jacket. The flange is operable to protect the control line during installation and operation of the sand control screen in the wellbore. An axially extending spring channel is coupled to the flange. The channel is operable to receive and retain the control line.

In a further aspect, the present invention is directed to a method for securing a control line to a sand control screen assembly for use in a subterranean wellbore. The method includes providing a sand control screen assembly having a base pipe with a screen jacket positioned therearound and a control line capture assembly having an axially extending flange coupled to the screen jacket and an axially extending spring channel coupled to the flange and positioning the control line in the spring channel such that the control line is retained by the spring channel and protected by the flange.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
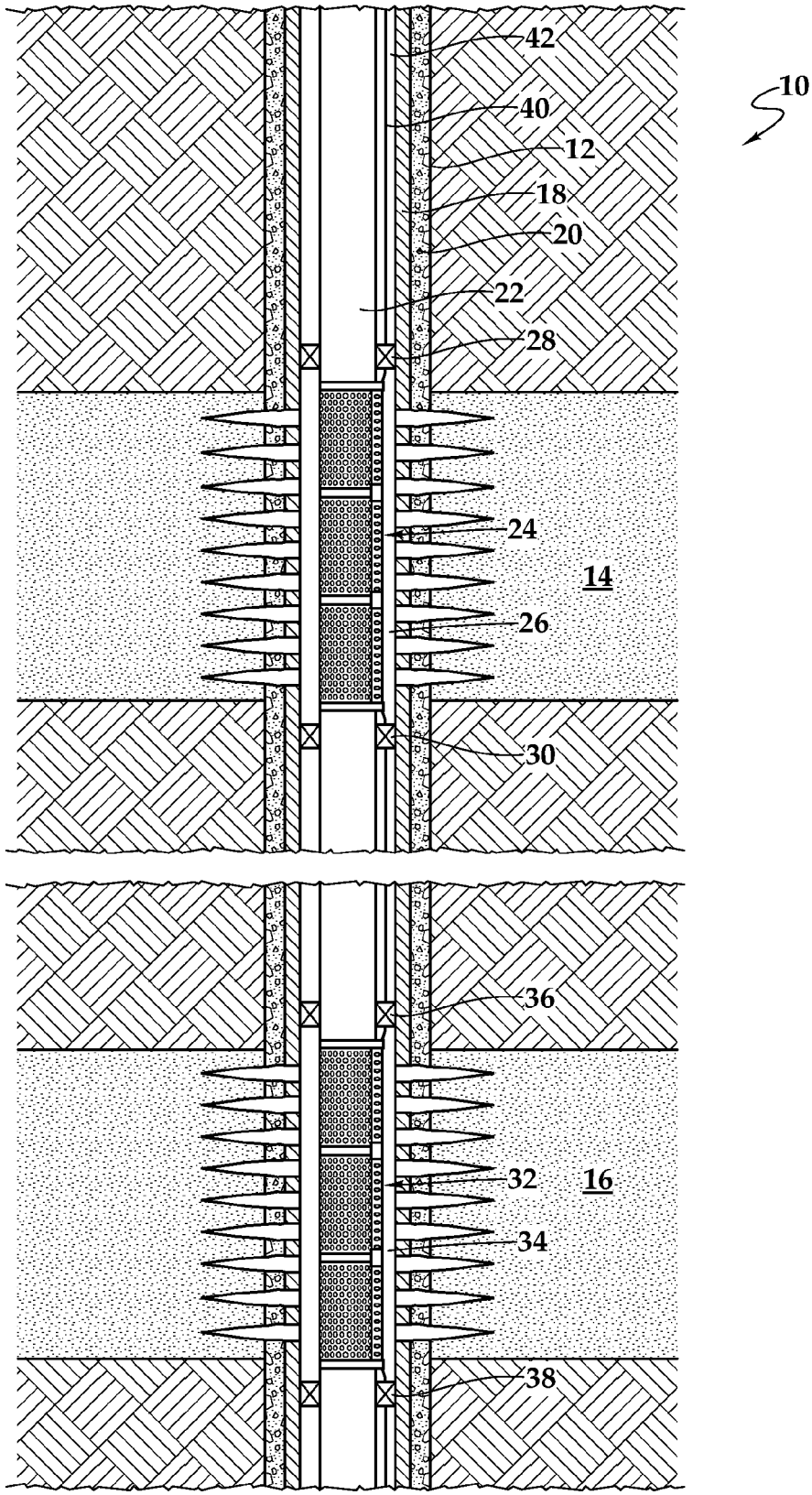
FIG. 1 is a schematic illustration of a wellbore environment including a pair of sand control screen assemblies having control line capture capability according to an embodiment of the present invention.

Referring initially to FIG. 1, a wellbore environment including a pair of production intervals having sand control screen assemblies positioned therein is schematically illustrated and generally designated 10. A wellbore 12 extends through the various earth strata including formations 14, 16. A casing 18 is supported within wellbore 12 by cement 20. A completion string 22 includes various tools such as a sand control screen assembly 24 that is positioned within production interval 26 between packers 28, 30. In addition, completion string includes a sand control screen assembly 32 that is positioned within production interval 34 between packers 36, 38. One or more control lines 40 extend from the surface within annulus 42 as pass through sand control screen assemblies 24, 32 to provide instructions, carry power, signals and data, and transport operating fluid, such as hydraulic fluid, to sensors, actuators and the like associated with sand control screen assemblies 24, 32 and other tools or components positioned downhole.

In one example, once completion string 22 is positioned as shown within wellbore 12, a treatment fluid containing sand, gravel, proppants or the like may be pumped down completion string 22 such that formations 14, 16 and production intervals 26, 34 may be treated. Sensors operably associated with completion string 22 may be used to provide substantially real time data to the operator via control line 40 on the effectiveness of the treatment operation such as identifying voids during the gravel placement process to allow the operator to adjust treatment parameters such as pump rate, proppant concentration, fluid viscosity and the like to overcome deficiencies in the gravel pack. In addition, such sensors may be used to provide valuable information to the operator via control line 40 during the production phase of the well such as fluid temperature, pressure, velocity, constituent composition and the like such that the operator can enhance the production operations.

Even though FIG. 1 depicts sand control screen assemblies 24, 32 in a cased hole environment, it should be understood by those skilled in the art that the sand control screen assemblies of the present invention are equally well suited for use in open hole environments. Also, even though FIG. 1 depicts a single sand control screen assembly having three screen jackets in each production interval, it should be understood by those skilled in the art that any number of sand control screen assemblies each having any number of screen jackets may be deployed within a production interval without departing from the principles of the present invention. Further, even though FIG. 1 depicts a vertical completion, it should be understood by those skilled in the art that the sand control screen assemblies of the present invention are equally well suited for use in well having other directional configurations including horizontal wells, deviated wells, slanted wells, multilateral wells and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
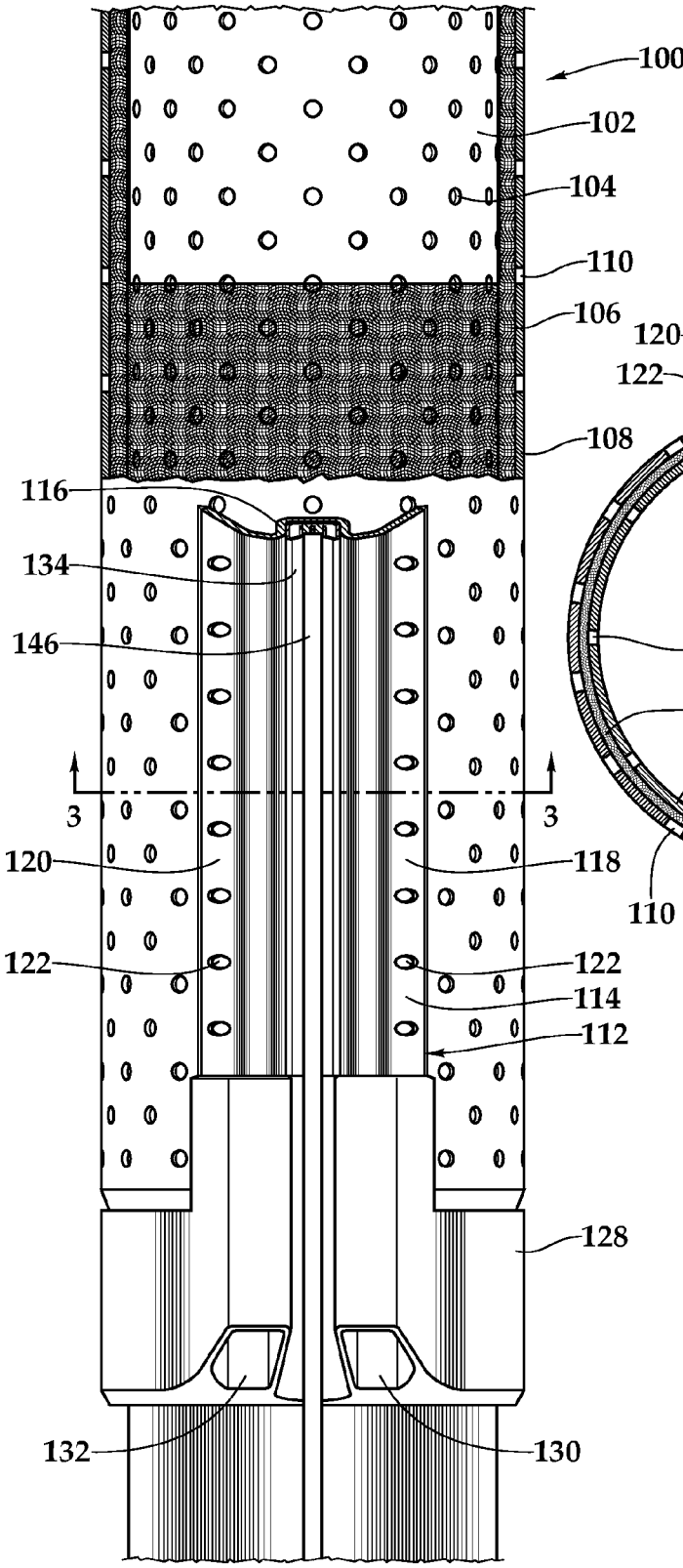
FIG. 2 is a partial cut away view of a sand control screen assembly having control line capture capability according to an embodiment of the present invention.

Referring now to FIG. 2, therein is depicted a partial cut away view of a sand control screen assembly of the present invention that is generally designated 100. Sand control screen assembly 100 includes a base pipe 102 that has a plurality of openings 104 which allow the flow of production fluids into the production tubing. The exact number, size and shape of openings 104 are not critical to the present invention, so long as sufficient area is provided for fluid production and the integrity of base pipe 102 is maintained. Positioned around base pipe 102 is a fluid-porous, particulate restricting filter medium such as a plurality of layers of a wire mesh that form a screen 106. Screen 106 is designed to allow fluid flow therethrough but prevent the flow of particulate materials of a predetermined size from passing therethrough. The layers of wire mesh may include drain layers that have a mesh size that is larger than the mesh size of the filter layers. For example, a drain layer may preferably be positioned as the outermost layer and the innermost layer of wire mesh screen 106 with the filter layer or layers positioned therebetween. Even though sand control screen assembly 100 has been depicted and described as having a wire mesh filter medium, it should be understood by those skilled in the art that the sand control screen assemblies of the present invention may use any type of filter media including, but not limited to, a single layer wire wrapped filter medium, a multi layer wire wrapped filter medium, a prepacked filter medium or the like that may include or exclude an outer shroud, without departing from the principles of the present invention.

Positioned around screen 106 is an outer shroud 108 that has a plurality of openings 110 which allow the flow of production fluids therethrough. The exact number, size and shape of openings 110 are not critical to the present invention, so long as sufficient area is provided for fluid production and the integrity of outer shroud 108 is maintained. Typically, various sections of screen 106 and outer shroud 108 are manufactured together as a unit and are commonly referred to as a screen jacket. Several screen jackets are typically placed over each joint of base pipe 102 and secured thereto by welding or other suitable technique.

Figure 3:
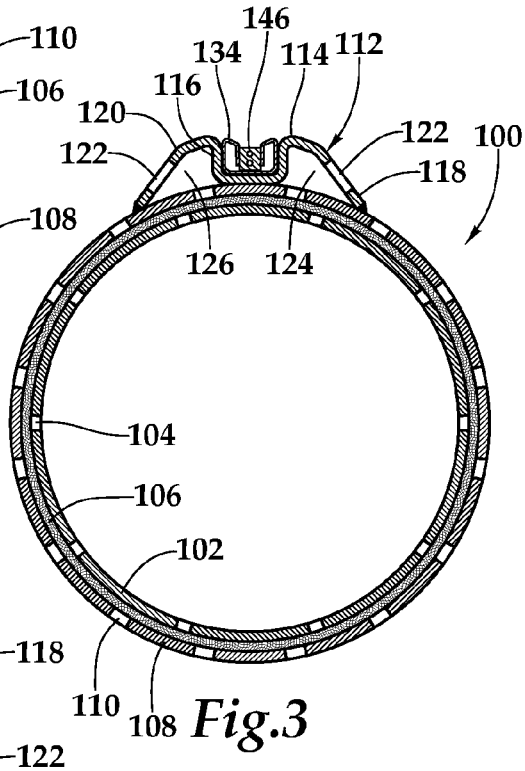
FIG. 3 is a cross sectional view of a sand control screen assembly having control line capture capability according to an embodiment of the present invention.
Figure 4:
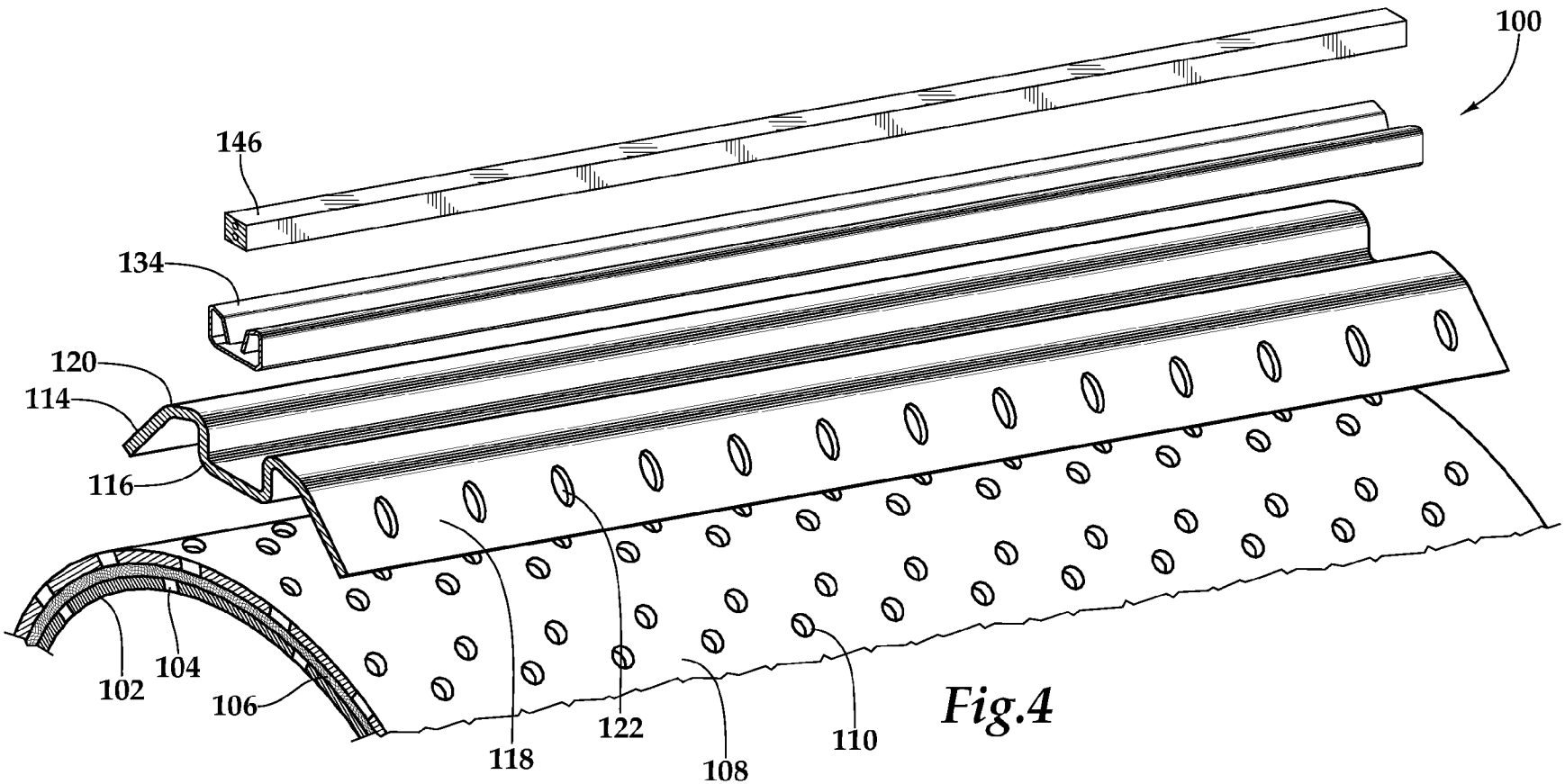
FIG. 4 is an exploded view of a sand control screen assembly having control line capture capability according to an embodiment of the present invention.

Sand control screen assembly 100 includes a control line capture assembly 112. Control line capture assembly 112 includes an axially extending flange 114 that is coupled to outer shroud 108 by welding or other suitable technique. As best seen in FIG. 4, flange 114 includes a channel receptacle 116 and a pair of oppositely disposed legs 118, 120. In the illustrated embodiment, legs 118, 120 each have a plurality of openings 122 that are axially distributed along legs 118, 120. Preferably, flange 114 is in the form of a metal angle that is configured to contact outer shroud 108 at the bottom of channel receptacle 116 and along the edge of legs 118, 120 such that flange 114 forms a pair of axially extending fluid passageways 124, 126 with outer shroud 108, as best seen in FIG. 3. At each end of sand control screen assembly 100, control line capture assembly 112 is positioned within a support ring 128 that includes a pair of fluid pathways 130, 132 that respectively align with fluid passageways 124, 126. Together, fluid pathways 130, 132 and fluid passageways 124, 126 provide additional fluid communication paths for axial flow of fluids downhole during, for example, a gravel pack operation which reduces the likelihood of sand bridging while performing such treatment operations.

Figure 5A:
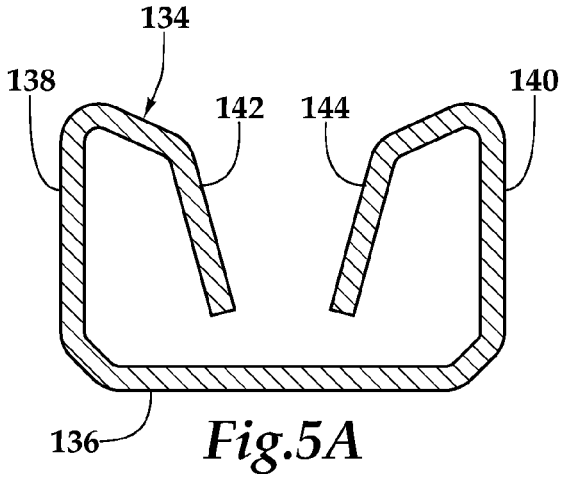
FIGS. 5A-5B are cross sectional views of a spring channel in its operating configurations for use in a sand control screen assembly having control line capture capability according to an embodiment of the present invention.
Figure 5B:
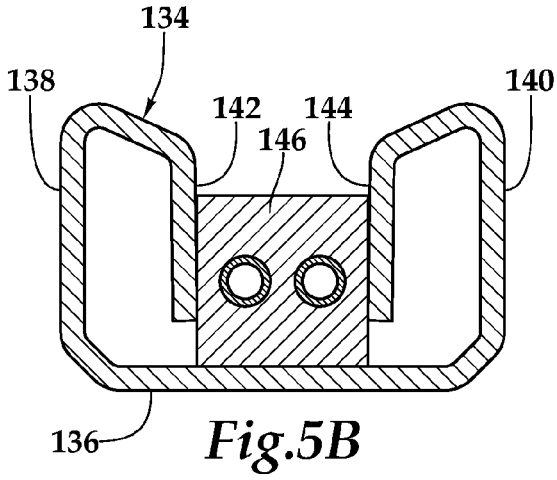

Control line capture assembly 112 includes an axially extending channel depicted as spring channel 134. Spring channel 134 is received within channel receptacle 116 of flange 114 and is coupled thereto by welding or other suitable technique. As best seen in FIG. 5A, spring channel 134 is in the form of a metal angle that has a base 136, a pair of oppositely disposed legs 138, 140 and a pair of oppositely disposed receiving arms 142, 144 that are operable to flex relative to legs 138, 140 enabling arms 142, 144 to exert a biasing force therebetween. As best seen in FIG. 5B, spring channel 134 is operable to receive and retain a control line 146 therein between arms 142, 144 which exert the aforementioned biasing force on control line 146. Control line 146 may include one or more instrument lines, such as copper wire, coaxial cable, fiber optics, twisted pairs or other lines suitable for transmitting power, signals, data and the like. In addition, control line 146 may include one or more fluid lines such as hydraulic lines or the like. As best seen in FIG. 3, flange 114 preferably extends radially outwardly beyond spring channel 134 such that flange 114 is operable to protect control line 146 during installation and operation of sand control screen assembly 100.

Figure 6A:
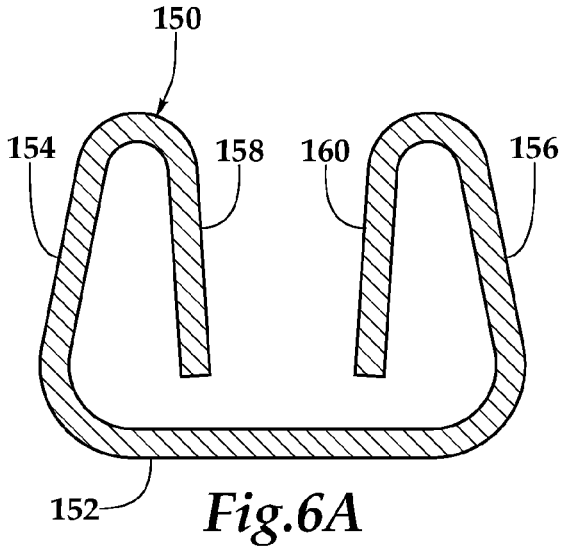
FIGS. 6A-6B are cross sectional views of a spring channel in its operating configurations for use in a sand control screen assembly having control line capture capability according to an embodiment of the present invention.
Figure 6B:
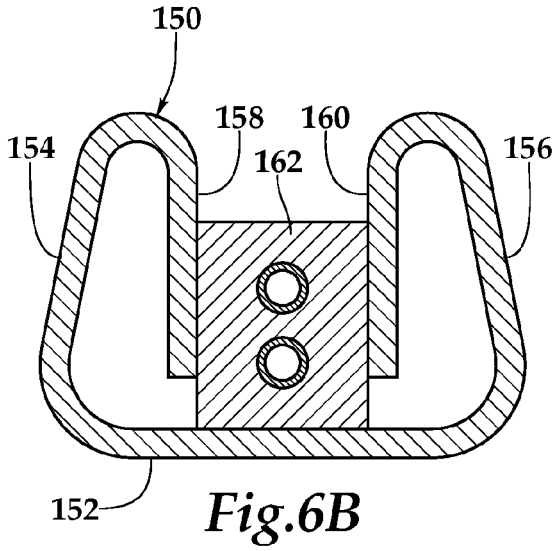

Preferably, the biasing force created by arms 142, 144 of spring channel 134 exerts a significant retention force on control line 146 such that control line 146 will not accidentally become dislodged from spring channel 134 during installation of sand control screen assembly 100 in the wellbore or during other operations. In certain installations, however, it may be desirable to be able to easily remove a control line from a spring channel of the present invention. For example, as best seen in FIG. 6A, spring channel 150 is in the form of a metal angle that has a base 152, a pair of oppositely disposed legs 154, 156 and a pair of oppositely disposed receiving arms 158, 160 that are operable to flex relative to legs 154, 156 enabling arms 158, 160 to exert a biasing force therebetween. As best seen in FIG. 6B, spring channel 150 is operable to receive and retain a control line 162 therein between arms 158, 160 which exert the aforementioned biasing force on control line 162, however, the retention force exerted by receiving arms 158, 160 on control line 162 is less than that exerted by receiving arms 142, 144 on control line 146 above enabling easier removal of control line 162, if desired.

Figure 7A:
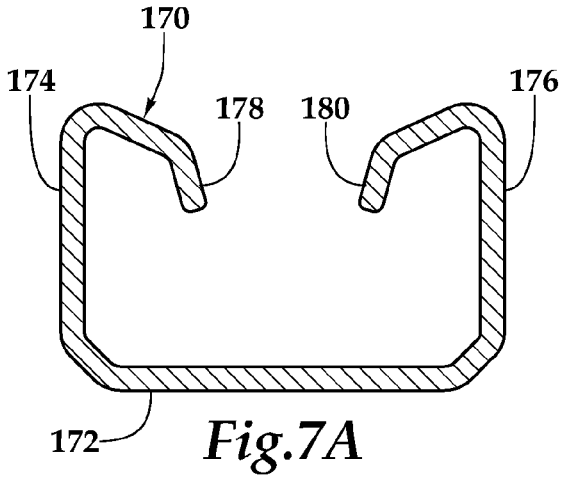
FIGS. 7A-7B are cross sectional views of a spring channel in its operating configurations for use in a sand control screen assembly having control line capture capability according to an embodiment of the present invention.
Figure 7B:
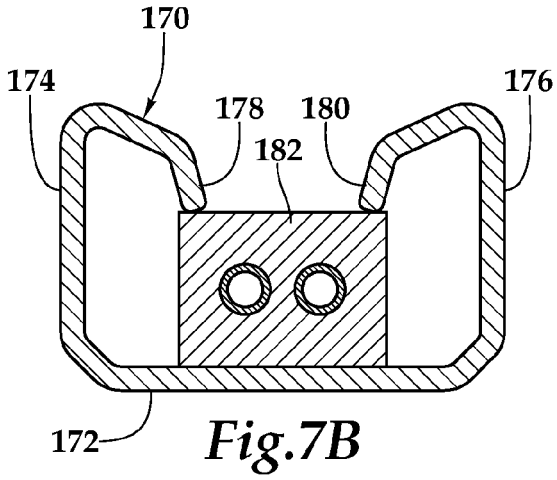

In other installations, it may be desirable to permanently position a control line in a spring channel of the present invention. For example, as best seen in FIG. 7A, spring channel 170 is in the form of a metal angle that has a base 172, a pair of oppositely disposed legs 174, 176 and a pair of oppositely disposed receiving arms 178, 180 that are operable to flex relative to legs 174, 176. As best seen in FIG. 7B, spring channel 170 is operable to receive and retain a control line 182, however, once control line 182 is fully inserted into spring channel 170, receiving arms 178, 180 snap back to their unbiased configuration such that control line 182 is locked in position between receiving arms 178, 180 and base 172.

In operation, each joint of sand control screen assembly 100 is preferably assembled in the shop prior to being transported to the wellsite. For example, each joint of sand control screen assembly 100 preferably includes a base pipe with multiple screen jackets attached thereto as described above with one or more axially extending control line capture assemblies 112 positioned between two support rings 128. Preferably, control line 146 is coupled to each joint of sand control screen assembly 100 at the wellsite during installation of the completion string. Specifically, after each adjacent joint of sand control screen assembly 100 is coupled to the next joint, preferably aligning adjacent control line capture assemblies 112 through the use of timed threads or other alignment technique, control line 146 is press fit into spring channel 134 of control line capture assembly 112. The process of inserting control line 146 into spring channel 134 may be a manual process or may be automated depending upon the facilities available on the well platform. Once the completion string is fully assembled, it is run downhole to the desired location with flange 114 protecting control line 146 during installation.

Thereafter, a treatment operation may proceed wherein a treatment fluid, such as a gravel pack slurry, is pumped downhole. Due to the fluid paths created by fluid pathways 130, 132 and fluid passageways 124, 126, the treatment fluid is able to travel around any sand bridges that may form adjacent to one of the sand control screen assemblies 100. Once production begins, due to openings 122 in legs 118, 120 of flange 114, there is minimal loss of screen area as production fluids enter fluid passageways 124, 126 and pass through the portion of screen 106 positioned adjacent thereto.

Figure 8A:
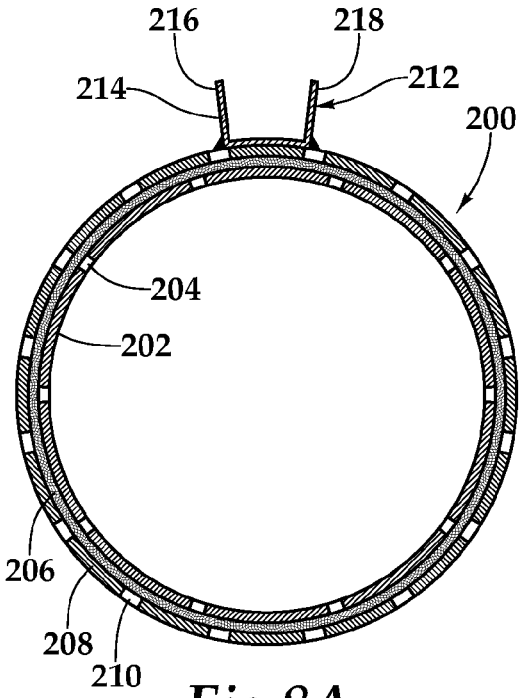
FIGS. 8A-8B are cross sectional views of a sand control screen assembly having control line capture capability according to an embodiment of the present invention.
Figure 8B:
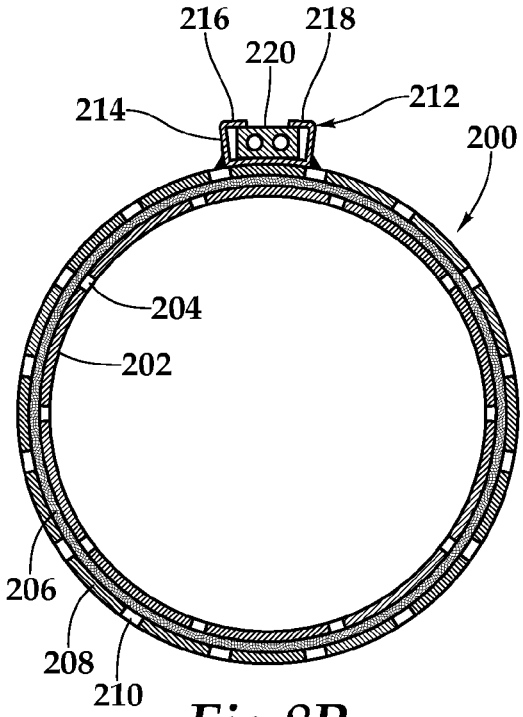

Referring now to FIGS. 8A-8B, therein are depicted another embodiment of a sand control screen assembly of the present invention that is generally designated 200. Sand control screen assembly 200 includes a base pipe 202 that has a plurality of openings 204 which allow the flow of production fluids into the production tubing. Positioned around base pipe 202 is a fluid-porous, particulate restricting filter medium depicted as screen 206 that is designed to allow fluid flow therethrough but prevent the flow of particulate materials of a predetermined size from passing therethrough. Positioned around screen 206 is an outer shroud 208 that has a plurality of openings 210 which allow the flow of production fluids therethrough. Sand control screen assembly 200 includes a control line capture assembly 212 that includes an axially extending flange 214 which is coupled to outer shroud 208 by welding or other suitable technique. Flange 214 includes a pair of radially extending legs 216, 218.

As best seen in FIG. 8B, flange 214 is deformable such that the end portions of legs 216, 218 are operable to retain control line 220 within control line capture assembly 212. Preferably, control line 220 is inserted into control line capture assembly 212 as the completion string is being assembled above the wellbore. Once control line 220 is in place, flange 214 is deformed on the well platform using a manual process or using an automated process depending upon the facilities available on the well platform such that the end portions of legs 216, 218 secure control line 220 within flange 214 over the entire length of control line capture assembly 212. For example, a forming plate located on the rig floor may be used to deform legs 216, 218 as the completion string is being lowered into the wellbore utilizing the weight of the completion string as the energy source for the deformation process. The forming plate may include a die that is configured to roll the ends of legs 216, 218 over control line 220 as control line 220 is fed into flange 212, thereby securing control line 220 therein.

Figure 9A:
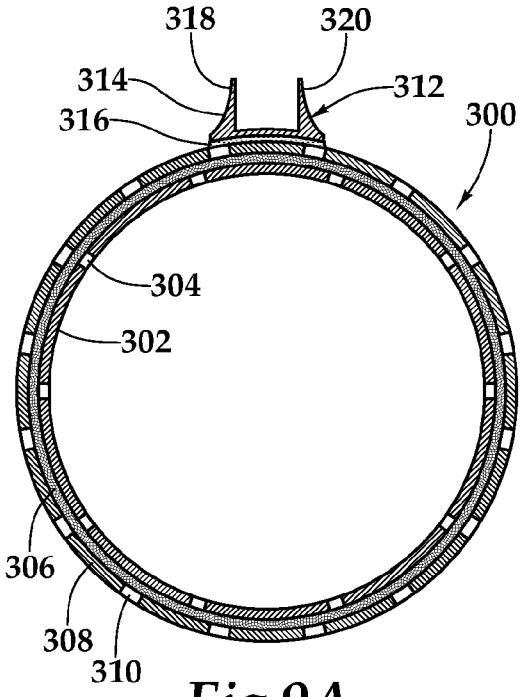
FIGS. 9A-9B are cross sectional views of a sand control screen assembly having control line capture capability according to an embodiment of the present invention.
Figure 9B:
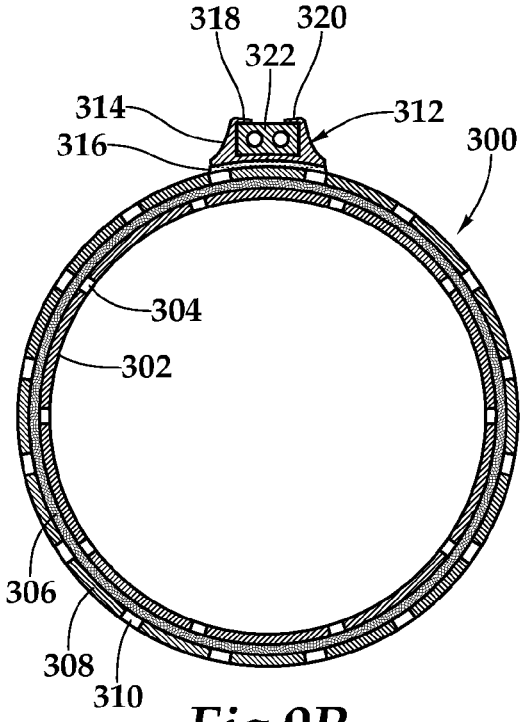

Referring now to FIGS. 9A-9B, therein are depicted another embodiment of a sand control screen assembly of the present invention that is generally designated 300. Sand control screen assembly 300 includes a base pipe 302 that has a plurality of openings 304 which allow the flow of production fluids into the production tubing. Positioned around base pipe 302 is a fluid-porous, particulate restricting filter medium depicted as screen 306 that is designed to allow fluid flow therethrough but prevent the flow of particulate materials of a predetermined size from passing therethrough. Positioned around screen 306 is an outer shroud 308 that has a plurality of openings 310 which allow the flow of production fluids therethrough. Sand control screen assembly 300 includes a control line capture assembly 312 that includes an axially extending flange 314 which is coupled to outer shroud 308 with a bonding agent 316. Flange 314 includes a pair of radially extending legs 318, 320.

As best seen in FIG. 9B, flange 314 is deformable such that the end portions of legs 318, 320 are operable to retain control line 322 within control line capture assembly 312. Preferably, control line 322 is inserted into control line capture assembly 312 as the completion string is being assembled above the wellbore. Once control line 322 is in place, flange 314 is deformed on the well platform using a manual process or using an automated process, such as that described above, depending upon the facilities available on the well platform such that the end portions of legs 318, 320 secure control line 322 within flange 314 over the entire length of control line capture assembly 312.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A sand control screen assembly having control line capture capability for use in a subterranean wellbore, the sand control screen assembly comprising:

a base pipe;

a screen jacket positioned around the base pipe that is operable to prevent the flow of particulate material of a predetermined size therethrough and to allow the flow of production fluids therethrough; and an axially extending flange exteriorly positioned about and coupled to the screen jacket, the flange having a channel receptacle positioned between a pair of oppositely disposed legs having a plurality axially distributed openings, the flange forming a pair of axially extending fluid passageways with the screen jacket, the openings in fluid communication with at least one of the fluid passageways; and an axially extending spring channel disposed within the channel receptacle, the spring channel having a pair of oppositely disposed receiving arms operable to flex to receive the control line therein and operable to exert a lateral biasing force on the control line to retain the control line therein.

2. The sand control screen assembly as recited in claim 1 wherein the screen jacket further comprises an outer shroud.

3. The sand control screen assembly as recited in claim 1 wherein the flange is welded to the screen jacket.

4. The sand control screen assembly as recited in claim 1 wherein the flange is bonded to the screen jacket.

5. A sand control screen assembly having control line capture capability for use in a subterranean wellbore, the sand control screen assembly comprising:

a base pipe;

a screen jacket positioned around the base pipe that is operable to prevent the flow of particulate material of a predetermined size therethrough and to allow the flow of production fluids therethrough; and a control line capture assembly exteriorly positioned about and coupled to the screen jacket, the control line capture assembly having an axially extending flange having a channel receptacle and an axially extending spring channel disposed within the channel receptacle, the spring channel having a pair of oppositely disposed receiving arms operable to flex to receive the control line therein and operable to exert a lateral biasing force on the control line to retain the control line therein.

6. The sand control screen assembly as recited in claim 5 wherein the screen jacket further comprises an outer shroud.

7. The sand control screen assembly as recited in claim 5 wherein the channel receptacle is positioned between a pair of oppositely disposed legs having a plurality axially distributed openings, wherein the flange forming a pair of axially extending fluid passageways with the screen jacket and wherein the openings are in fluid communication with at least one of the fluid passageways.

8. The sand control screen assembly as recited in claim 5 wherein the flange is welded to the screen jacket.

9. The sand control screen assembly as recited in claim 5 wherein the channel is welded to the flange.

10. A method for securing a control line to a sand control screen assembly for use in a subterranean wellbore, the method comprising:

providing a sand control screen assembly having a base pipe with a screen jacket positioned therearound and a control line capture assembly exteriorly positioned about and coupled to the screen jacket, the control line capture assembly having an axially extending flange having a channel receptacle and an axially extending spring channel disposed within the channel receptacle;

positioning the control line in the spring channel by flexing a pair of oppositely disposed receiving arms of the spring channel; and retaining the control line within the spring channel by exerting a lateral biasing force on the control line with the receiving arms.

11. The method as recited in claim 10 wherein the channel receptacle is positioned between a pair of oppositely disposed legs.

12. The method as recited in claim 11 wherein each of the legs has a plurality axially distributed openings.

13. The method as recited in claim 11 wherein the flange forms a pair of axially extending fluid passageways with the screen jacket.

* * * * *